US009872107B2

(12) United States Patent
Kochendoerfer et al.

(10) Patent No.: US 9,872,107 B2
(45) Date of Patent: Jan. 16, 2018

(54) ELECTRODYNAMIC TRANSDUCER WITH BACK COVER FOR HEAT DISSIPATION

(71) Applicant: Harman International Industries, Incorporated, Stamford, CT (US)

(72) Inventors: Felix Kochendoerfer, Sherman Oaks, CA (US); Alex Pliner, Van Nuys, CA (US); Alexander Voishvillo, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 14/996,813

(22) Filed: Jan. 15, 2016

(65) Prior Publication Data

US 2016/0212543 A1 Jul. 21, 2016

Related U.S. Application Data

(60) Provisional application No. 62/104,379, filed on Jan. 16, 2015.

(51) Int. Cl.

| | |
|---|---|
| ***H04R 9/02*** | (2006.01) |
| ***H04R 9/06*** | (2006.01) |
| *H04R 1/02* | (2006.01) |

(52) U.S. Cl.

CPC ..... *H04R 9/022* (2013.01); *H04R 9/06* (2013.01); *H04R 1/028* (2013.01)

(58) Field of Classification Search

CPC . H04R 9/00; H04R 9/022; H04R 9/06; H04R 1/028

USPC ..... 381/396, 397, 412, 420

See application file for complete search history.

(56) References Cited

U.S. PATENT DOCUMENTS

| | | | | |
|---|---|---|---|---|
| 6,373,957 | B1 * | 4/2002 | Stewart | H04R 9/022 381/397 |
| 6,678,387 | B2 * | 1/2004 | Kemmerer | H04R 9/06 181/148 |
| 2008/0025549 | A1 * | 1/2008 | Avera | H04R 9/022 381/397 |
| 2014/0105439 | A1 * | 4/2014 | Wirth | H04R 1/00 381/338 |

OTHER PUBLICATIONS

Button, Douglas J., Heat Dissipation and Power Compression in Loudspeakers, J. Audio Engineering Society, vol. 40, No. 1/2, Jan./Feb. 1992, pp. 32-41 (Presented at the 89th Convention of the Audio Engineering Society, Los Angeles, CA, Sep. 21-25, 1990).

Alexander Voishvillo, Audio Engineering Society, Convention Paper 5912, Presented at the 115th Convention, Oct. 10-13, 2003, New York, New York, pp. 1-24.

* cited by examiner

*Primary Examiner* — Sunita Joshi
(74) *Attorney, Agent, or Firm* — Brooks Kushman P.C.

(57) ABSTRACT

An electrodynamic transducer includes a motor assembly and a diaphragm disposed forward of the motor assembly, the diaphragm having a front surface and a rear surface. A back cover supports the motor assembly and the diaphragm, the back cover creating an air cavity beneath the diaphragm rear surface. The back cover includes at least one heat-conducting member providing a heat transfer path from the motor assembly to the back cover.

20 Claims, 5 Drawing Sheets

ELECTRODYNAMIC TRANSDUCER WITH BACK COVER FOR HEAT DISSIPATION

CROSS-REFERENCE TO RELATED APPLICATIONS

This application claims the benefit of U.S. provisional application Ser. No. 62/104,379 filed Jan. 16, 2015, the disclosure of which is hereby incorporated in its entirety by reference herein

TECHNICAL FIELD

Embodiments relate to an electrodynamic transducer having a back cover with heat-conducting elements for heat dissipation.

BACKGROUND

Electrodynamic transducers used in professional applications require unaltered performance even at very high excitation levels. When excited with a high level of input signal, the electrical current running through the voice coil causes an increase in the voice coil temperature which leads to a higher voice coil resistance and, as a result, higher electric losses. Eventually, very high temperatures will lead to a complete failure of the voice coil assembly. Higher electric losses in turn cause so-called thermal compression, decrease of the sound pressure level, and decrease of electrodynamic damping. This is explained by the fact that most electrodynamic transducers work with amplifiers that are sources of voltage. The electric losses hence decrease the voice coil current and correspondingly the force driving the voice coil.

Many loudspeaker systems require an acoustical separation of the different transducers. The separation of mid-range transducers (air sealing) is usually done by putting them in a separate sealed enclosure, such as a back cover. This prevents undesirable modulation of the diaphragm by sound pressure produced by the low frequency transducers (woofers). The air in such a back cover does not allow much dissipation of the heat generated by the transducer since there is no thermal exchange with the air outside the loudspeaker system. Due to the small volume of the back cover, the voice coil temperature may significantly increase.

The air trapped in the back cover also acts as a nonlinear acoustic compliance, which can have a significant influence on the overall mechanical stiffness of the transducer (A. Voishvillo, "Nonlinear Versus Parametric Effects In Compression Drivers", 115th AES Convention, preprint 5912, 2003, New York). Due to the nature of the air, the stiffness changes differently for inward or outward movement of the diaphragm or cone. The relation between the stiffness of the air $K_{ma}$ and the displacement of the cone x can be described as:

$$K_{ma}(x) = \frac{\gamma p_0 V_0^{\gamma} S_d^2}{(V_0 + xS_d)^{\gamma+1}} \tag{1}$$

where $S_d$ is the effective surface area of the cone, $V_0$ is the volume of the back cover, $p_0$ is the static air pressure in the back cover and $\gamma$ is the adiabatic index of air.

Expression (1) can be also written as:

$$K_{ma}(x) = \frac{\rho c^2 V_0^{\gamma} S_d^2}{(V_0 + xS_d)^{\gamma+1}} \tag{2}$$

where $\rho$ is the density of air, and c is the speed of sound.

The mechanical stiffness of a transducer in a sealed enclosure includes the stiffness of the transducer's suspension $K_{ms}$ and the stiffness of the sealed back cavity $K_{ma}$:

$$K_m(x)=K_{ms}(x)+K_{ma}(x) \tag{3}$$

This way, a small volume of the air cavity not only has a significant influence on the overall stiffness of the system, but also on its nonlinearity.

In order to provide an acoustical insulation, a back cover as illustrated in FIG. 1 is a common prior solution. Its volume can be adjusted to fulfill requirements for the mechanical behavior of the transducer and the space in the loudspeaker system. As mentioned above, the small amount of air in the rear cavity surrounding the motor does not provide good heat transfer from the motor to the outside environment. Thus, the motor will heat up much faster in the back cover than without it.

Another prior option has been to seal the frame of the transducer which is attached to the top plate of the motor. This way, most of the motor will be outside of the sealed enclosure as illustrated in FIG. 2. This design provides better heat dissipation since most of the motor parts have direct contact with the air outside of the cavity. Additionally, heat transfer may be improved by attaching a heat sink on the back of the motor. This design also makes a separate back cover redundant because the acoustic isolation is provided by the sealed frame.

The disadvantage of the design in FIG. 2 is that the volume of the air cavity is limited by the transducer dimension. The small volume between the frame and the cone leads to a significant increase of the stiffness which limits the lower end of the frequency range where the transducer might be used. Additionally, the nonlinearity of the air stiffness may increase the distortion generated by the transducer.

SUMMARY

In one embodiment, an electrodynamic transducer is provided which includes a motor assembly and a diaphragm disposed forward of the motor assembly, the diaphragm having a front surface and a rear surface. A back cover supports the motor assembly and the diaphragm, the back cover creating an air cavity beneath the diaphragm rear surface. The back cover includes at least one heat-conducting member providing a heat transfer path from the motor assembly to the back cover.

In another embodiment, an electrodynamic transducer is provided including a motor assembly that provides a magnetic field across an air gap, and a diaphragm disposed forward of the motor assembly, the diaphragm having a front surface and a rear surface. A voice coil is operably connected to the diaphragm and supported in the air gap, wherein excitation of the voice coil by the magnetic field causes movement of the diaphragm. A back cover supports the motor assembly and the diaphragm, the back cover having an internal surface and an external surface, and creating an air cavity beneath the diaphragm rear surface. The back cover includes a plurality of heat-conducting interior fins disposed on the internal surface and arranged to contact the motor assembly, the interior fins providing a heat transfer path from the motor assembly to the back cover.

In another embodiment, a loudspeaker system is provided, including an enclosure and a transducer mounted within the enclosure. The transducer includes a motor assembly and a diaphragm disposed forward of the motor assembly, the diaphragm having a front surface and a rear surface. A back cover supports the motor assembly and the diaphragm, the back cover creating an air cavity beneath the diaphragm rear surface. The back cover includes at least one heat-conducting member providing a heat transfer path from the motor assembly to the back cover. The loudspeaker system further includes a heat-conducting conduit mounted to an external surface of the back cover, the heat-conducting conduit extending to a wall of the enclosure.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Embodiments disclosed herein relate to improvement of heat transfer in electrodynamic moving coil transducers 10 with hermetic air sealing of the rear surface of the diaphragm. More particularly, embodiments relate to a back cover for an electrodynamic transducer which includes at least one heat-conducting member which allows a direct heat transfer path from the transducer motor assembly to the outside of the back cover.

Figure 3:
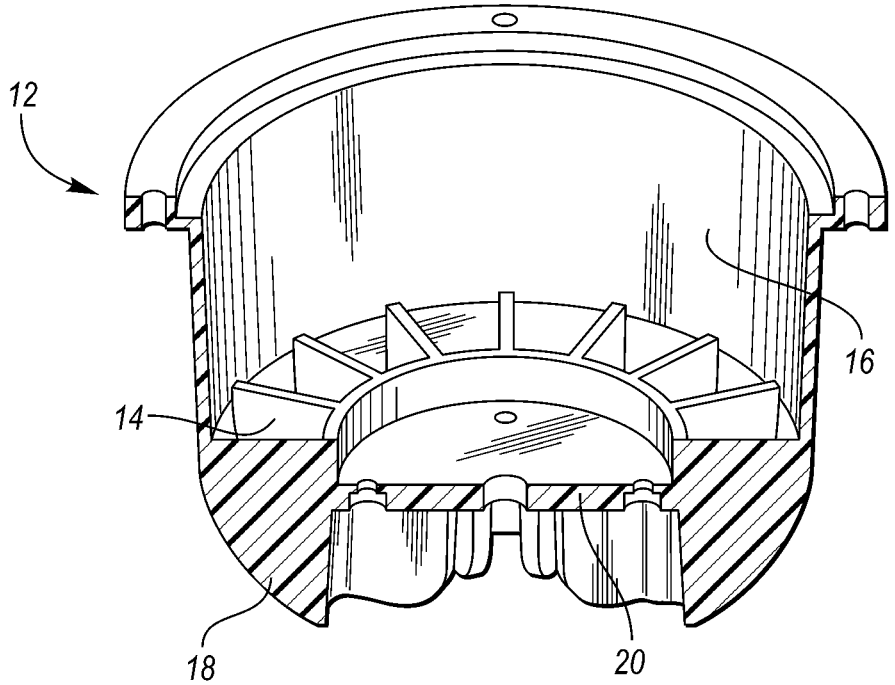
FIG. 3 is a cross-sectional view of a back cover with heat-conducting interior fins for cooling of the transducer motor.
Figure 4:
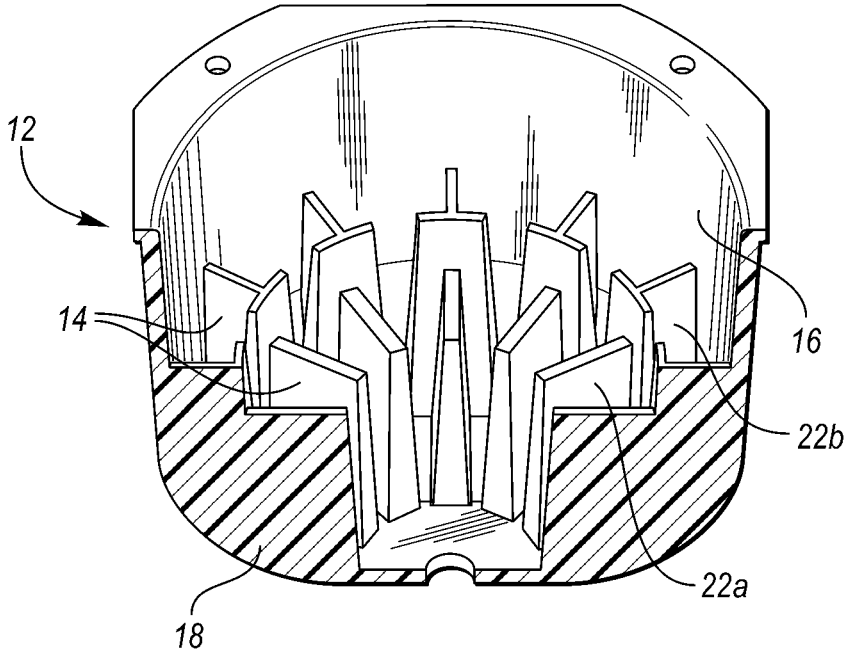
FIG. 4 is a cross-sectional view of a back cover with another configuration of heat-conducting interior fins for cooling of the transducer motor.

FIGS. 3 and 4 depict two different embodiments of a back cover 12 including a plurality of heat-conducting interior fins 14 disposed on an internal surface 16 of the back cover 12 for cooling of the transducer motor assembly. As shown, the use of special interior fins 14 to conduct the heat to an external surface 18 of the back cover 12 allows the volume of the back cover 12 to remain flexible. The interior fins 14 are constructed from a heat-conducting material, such as metallic fins with high thermal conductivity. In the embodiment of FIG. 3, the interior fins 14 are formed so as to extend radially outward from a motor support portion 20 of the back cover 12 and are arranged to contact the motor assembly.

In the embodiment of FIG. 4, the interior fins 14 are arranged in concentric circles with an inner circle 22*a* abutting an outer circle 22*b*. The fins 14 of the inner circle 22*a* have a first length and form a base of the motor support portion 20. The fins 14 of the outer circle 22*b* have a second length greater than the first length, and have a generally T-shaped cross-section so as to form an outer edge of the motor support portion 20. Of course, it is understood that the interior fins 14 are not limited to the configurations shown and described herein, and can have any suitable configuration suitable to transfer heat from the motor assembly to the back cover 12.

Figure 1:
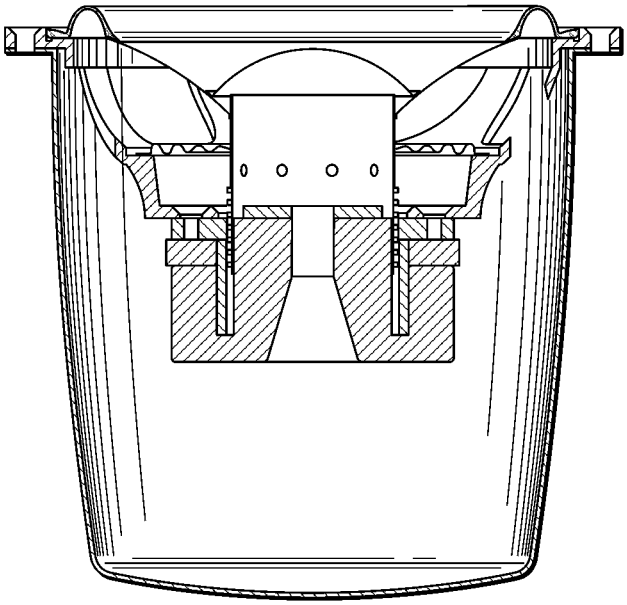
FIG. 1 (PRIOR ART)
FIG. 1 is a cross-sectional view of a prior art electrodynamic mid-range transducer in a back cover.
Figure 2:
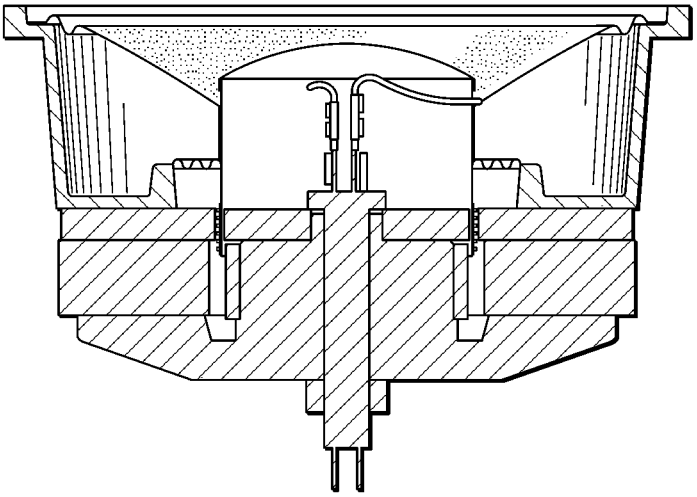
FIG. 2 (PRIOR ART)
FIG. 2 is a cross-sectional view of a prior art transducer with the sealed frame (1) mounted on top of the motor (2)
Figure 5:
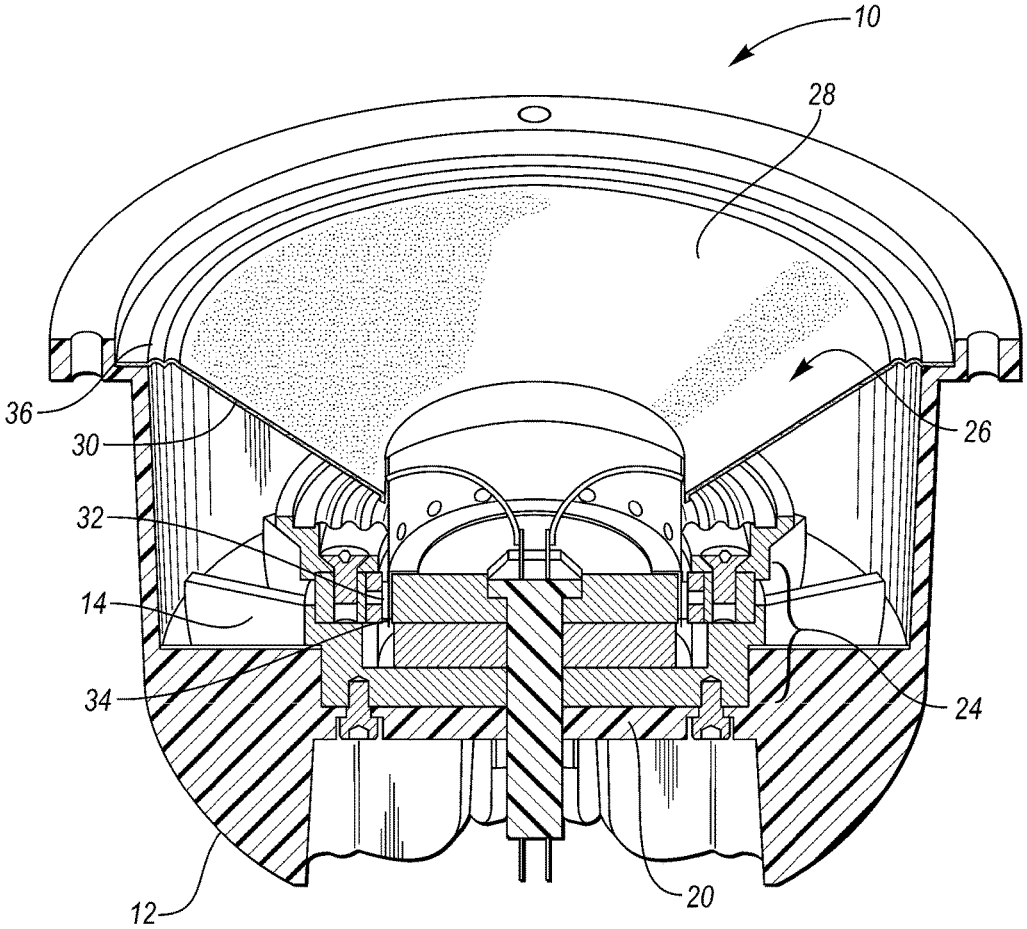
FIG. 5 is cross-sectional view of a back cover which functions as a frame by directly supporting the surround of the transducer.

With reference to FIG. 5, the transducer 10 includes a motor assembly 24 and a diaphragm 26 disposed forward of the motor assembly 24, where the diaphragm 26 has a front surface 28 and a rear surface 30. The back cover 12 supports the motor assembly 24 and the diaphragm 26, and creates an air cavity beneath the diaphragm rear surface 30. The motor assembly 24 provides a magnetic field across an air gap 32, and a voice coil 34 is operably connected to the diaphragm 26 and supported in the air gap 32, wherein excitation of the voice coil 34 by the interaction of the magnetic field and the voice coil current causes movement of the diaphragm 26. As shown, the back cover 12 can be directly attached to the motor assembly 20. The back cover 12 can also function as a frame since it can support the surround 36 attached to the diaphragm 26 as illustrated. This is not possible with prior art back covers as illustrated, for example, in FIG. 1.

Figure 6:
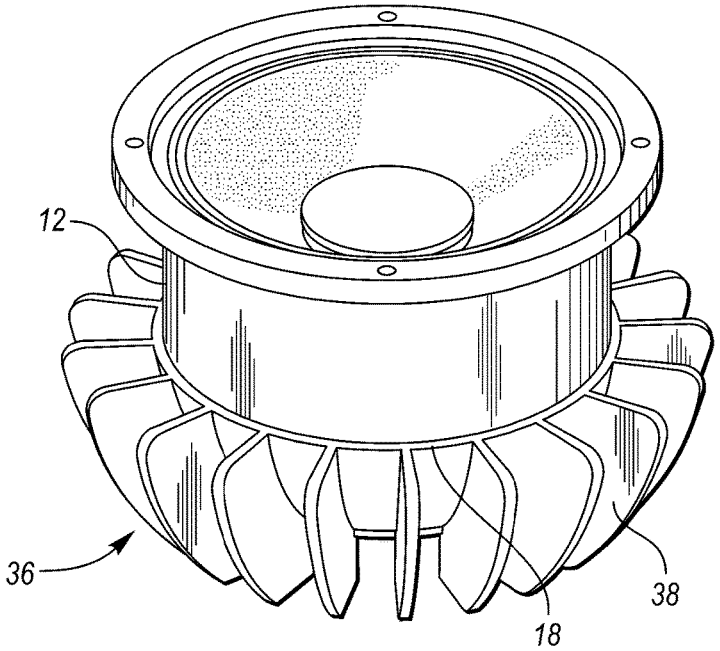
FIG. 6 is a top perspective view of the heat sink member mounted to a back cover.
Figure 7:
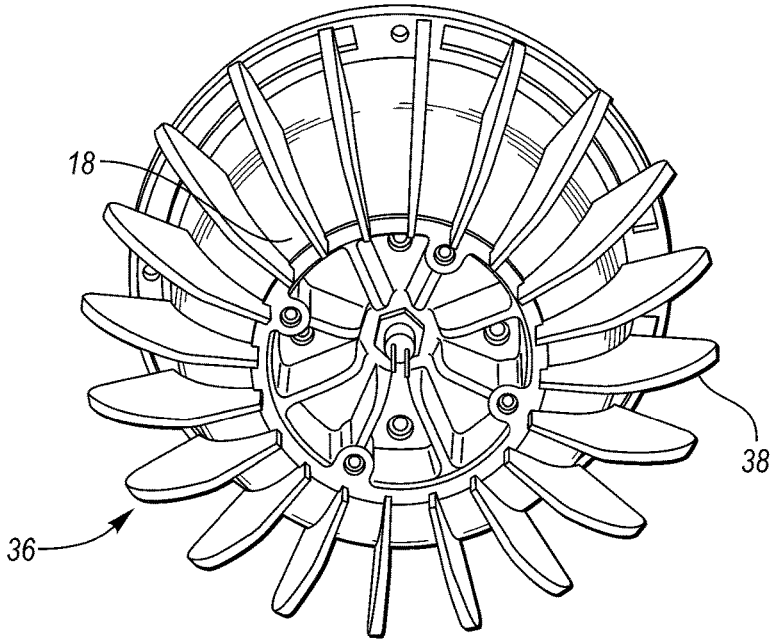
FIG. 7 is a bottom perspective view of the heat sink member of FIG. 6.

Since the heat generated by the motor assembly 24 will be transmitted directly to the back cover 12, a substantial part of the heat dissipation will take place on the external surface 18 of the back cover 12. As such, it is possible to improve the overall cooling of the transducer 10 by providing a heat sink member 36, as shown in FIGS. 6 and 7, mounted to the external surface 18 of the back cover 12. The heat sink member 36 is constructed from a heat-conducting material, such as metal. As illustrated, the heat sink member 36 can include radially extending, heat-dissipating exterior fins 38. In the embodiment shown, the exterior fins 38 extend outwardly beyond the footprint of the back cover 12. Again, it is understood that the heat sink member 36 is not limited to this configuration, and can have other configurations suitable for radiating heat away from the back cover 12. Advantageously, the heat sink member 36 does not change the volume of the air cavity within the back cover 12, and thus will have no effect on the mechanical behavior of the transducer 10.

Figure 8:
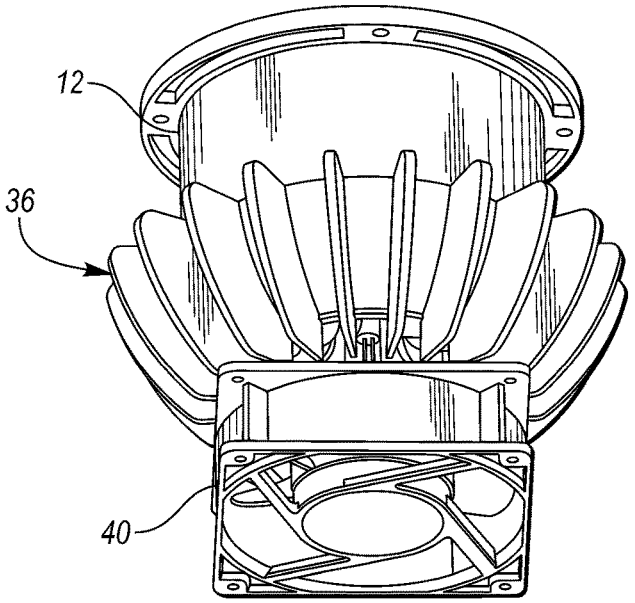
FIG. 8 is a perspective view illustrating a fan mounted to the heat sink member of FIG. 6.

In order to improve cooling of the transducer 10 even more, an active cooling system, such as a fan 40 as shown in FIG. 8, can be coupled to the external surface 18 of the back cover 12, either mounted to a bottom portion of the heat sink member 36 or directly to the external surface 18 of the back cover 12. The fan 40 or other active cooling system can have any appropriate size and configuration for operation attached directly or indirectly to the back cover 12. As with the heat sink member 36, the fan 40 will have no effect on the mechanical behavior of the transducer 10, since it does not change the volume of the air cavity within the back cover 12.

Figure 9:
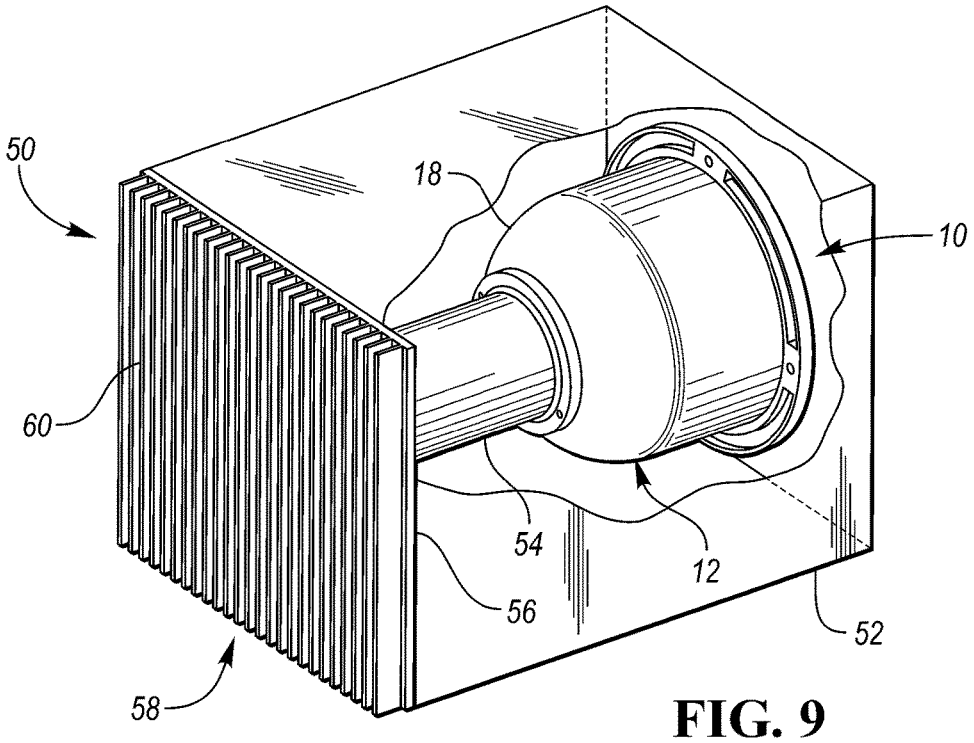
FIG. 9 is a perspective view illustrating an additional heat-conducting element thermally connecting the back cover with a heat sink member positioned externally on a wall of a loudspeaker system enclosure.

FIG. 9 illustrates a loudspeaker system 50 which includes an enclosure 52 and a transducer 10 mounted within the enclosure 52. As described above with reference to FIGS. 3-8, the back cover 12 includes at least one heat-conducting member providing a heat transfer path from the motor assembly to the back cover 12. The loudspeaker system 50 may further include at least one heat-conducting conduit 54 (for example, a metal rod or heat pipe) mounted to the external surface 18 of the back cover 12. The conduit 54 extends to a wall (e.g. the rear wall 56, a cutaway section of which is shown in FIG. 9) of the enclosure 52. The conduit 54 may thermally connect the back cover 12 to a heat sink member 58 mounted to an exterior of the wall 56, and may be aligned with the heat-conducting conduit 54. The heat sink member 58 may include a plurality of parallel heat-conducting fins 60 as depicted, or any other configuration suitable for mounting on the exterior of the enclosure 52 for heat dissipation of the transducer 10.

Embodiments disclosed herein may be used, for example, in mid-range transducers for loudspeaker systems where a high level of performance with low thermal compression is important, such as in touring loudspeakers, portable loudspeakers, studio monitors, installed sound professional loudspeakers, automotive and consumer loudspeakers.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An electrodynamic transducer, comprising:

a motor assembly;

a diaphragm disposed forward of the motor assembly, the diaphragm having a front surface and a rear surface; and a back cover supporting the motor assembly and the diaphragm, the back cover creating an air cavity beneath the diaphragm rear surface, the back cover including at least one heat-conducting member providing a heat transfer path from the motor assembly to the back cover, wherein the at least one heat-conducting member includes a plurality of heat-conducting interior fins disposed on an internal surface of the back cover and arranged to contact the motor assembly, wherein the interior fins are arranged in concentric circles with a first set of fins forming an inner circle and a second set of fins forming an outer circle.

2. The transducer of claim 1, wherein the back cover includes a motor support portion, and the interior fins extend radially outward from the motor support portion.

3. The transducer of claim 1, wherein the first set of fins of the inner circle have a first length and form a base of a motor support portion of the back cover, and wherein the second set of fins of the outer circle have a second length greater than the first length.

4. The transducer of claim 1, further comprising a surround attached to the diaphragm, wherein the back cover supports the surround.

5. The transducer of claim 1, further comprising a heat sink member mounted on an external surface of the back cover.

6. The transducer claim 5, wherein the heat sink member includes heat-dissipating exterior fins.

7. The transducer of claim 6, wherein the exterior fins extend radially outwardly beyond a footprint of the back cover.

8. The transducer of claim 1, further comprising a fan coupled to an external surface of the back cover.

9. An electrodynamic transducer, comprising:

a motor assembly that provides a magnetic field across an air gap;

a diaphragm disposed forward of the motor assembly, the diaphragm having a front surface and a rear surface;

a voice coil operably connected to the diaphragm and supported in the air gap, wherein excitation of the voice coil causes movement of the diaphragm; and a back cover supporting the motor assembly and the diaphragm, the back cover having an internal surface and an external surface, the back cover creating an air cavity beneath the diaphragm rear surface, the back cover including a plurality of heat-conducting interior fins disposed on the internal surface and arranged to contact the motor assembly, the interior fins providing a heat transfer path from the motor assembly to the back cover, wherein the interior fins are arranged in concentric circles with an inner circle abutting an outer circle, wherein the fins of the inner circle have a first length and form a base of a motor support portion of the back cover, wherein the fins of the outer circle have a second length greater than the first length.

10. The transducer of claim 9, wherein the back cover includes a motor support portion, and the interior fins extend radially outward from the motor support portion.

11. The transducer of claim 9, wherein the fins of the outer circle have a T-shaped cross-section to form an outer edge of the motor support portion.

12. The transducer of claim 9, further comprising a surround attached to the diaphragm, wherein the back cover supports the surround.

13. The transducer of claim 9, further comprising a heat sink member mounted on the external surface of the back cover.

14. The transducer claim 13, wherein the heat sink member includes heat-dissipating exterior fins.

15. The transducer of claim 9, further comprising a fan coupled to the external surface of the back cover.

16. A loudspeaker system, comprising:

an enclosure;

a transducer mounted within the enclosure, the transducer including a motor assembly, a diaphragm disposed forward of the motor assembly, the diaphragm having a front surface and a rear surface, and a back cover supporting the motor assembly and the diaphragm, the back cover creating an air cavity beneath the diaphragm rear surface, the back cover including at least one heat-conducting member providing a heat transfer path from the motor assembly to the back cover; and a heat-conducting conduit mounted to an external surface of the back cover and spaced from the motor assembly, the heat-conducting conduit extending to a wall of the enclosure.

17. The loudspeaker system of claim 16, further comprising a heat sink member mounted to an exterior of the wall and aligned with the heat-conducting conduit.

18. The loudspeaker system of claim 17, wherein the heat sink member includes a plurality of heat-dissipating fins.

19. The loudspeaker system of claim 16, wherein the at least one heat-conducting member includes a plurality of heat-conducting interior fins disposed on an internal surface of the back cover and arranged to contact the motor assembly.

20. The transducer of claim 3, wherein the second set of fins of the outer circle have a T-shaped cross-section to form an outer edge of the motor support portion.

* * * * *